US006957657B2

(12) United States Patent
Choinard

(10) Patent No.: US 6,957,657 B2
(45) Date of Patent: Oct. 25, 2005

(54) SAFETY VALVE, IN PARTICULAR FOR COOKING PLATE GAS AND RELATED MOUNTING METHOD

(75) Inventor: Philippe Choinard, St Branchs (FR)

(73) Assignee: Burner Systems International (BSI), Veigne (FR)

( * ) Notice: Subject to any disclaimer, the term of this patent is extended or adjusted under 35 U.S.C. 154(b) by 88 days.

(21) Appl. No.: 10/472,955

(22) PCT Filed: Apr. 12, 2002

(86) PCT No.: PCT/FR02/01280

§ 371 (c)(1),
(2), (4) Date: Sep. 24, 2003

(87) PCT Pub. No.: WO02/084180

PCT Pub. Date: Oct. 24, 2002

(65) Prior Publication Data

US 2004/0089286 A1 May 13, 2004

(30) Foreign Application Priority Data

Apr. 13, 2001 (FR) ..... 01 05087

(51) Int. Cl.[7] ..... F23N 5/10
(52) U.S. Cl. ..... 137/66; 251/231; 251/233; 433/254
(58) Field of Search ..... 137/66, 65; 251/231, 251/233; 431/254, 255, 72, 77

(56) References Cited

U.S. PATENT DOCUMENTS 5,193,993 A * 3/1993 Dietiker ..... 137/66
6,192,913 B1 * 2/2001 Willey et al. ..... 137/66

FOREIGN PATENT DOCUMENTS

| | | |
|---|---|---|
| DE | 4441926 | 6/1995 |
| DE | 19616797 | 7/1997 |
| EP | 1058059 | 12/2000 |
| GB | 2242257 | 9/1991 |
| GB | 2261495 | 5/1993 |

* cited by examiner

*Primary Examiner*—Kevin Lee
(74) *Attorney, Agent, or Firm*—DLA Piper Rudnick Gray Cary US LLP

(57) ABSTRACT

The invention concerns a safety gas valve (1) provided with a safety closure (23) and an operating lever (12) for the closure. The lever (12) is mounted mobile in rotation about an axis L in a cavity (34) circulating the gas and comprises two tabs (122, 123) extending transversely to the axis L, one driving and the other driven. The driving tab (122) drives the lever in rotation, and hence the driven tab (123) which is secured thereto, in response to a stress A when the valve is opened. The driven tab (123) enables to push back the safety closure (23) into an opening position allowing the gas to flow in the valve. If both tabs extend along respective mutually perpendicular directions, the lever (12) enables the cocking movement to return by 90 degrees. Said device reduces the thickness of the valve body, in particular for its fixing into a built-in cooking plate.

14 Claims, 3 Drawing Sheets

SAFETY VALVE, IN PARTICULAR FOR COOKING PLATE GAS AND RELATED MOUNTING METHOD

BACKGROUND OF THE INVENTION

The present invention relates to improvements made to safety devices for gas burners, particularly in a cooking appliance, and particularly those suited to be mounted on a built-in hob equipped with gas burners. The invention is aimed more specifically at improving a safety device for a gas burner according to the preamble of claim 1.

The gases used as fuel to produce energy, and which when mixed with air under certain conditions produce explosive mixtures, are dangerous and require the use of safety devices. In particular, valves for cooking appliances employing gas burners, in addition to having a flow-regulating control valve for the gas, are also equipped with such devices. These in particular allow the gas supply to be cut off as soon as the gas is not being burnt in a burner.

These safety devices generally employ a thermocouple, arranged in the burner, to monitor its correct operation and a safety shutter which, in the event of failure, allows any circuit supplying gas to the burner to be shut off. When the burner is operating normally, the heat from the flame causes a difference in electric potential in the thermocouple. This potential difference is used to activate an electromagnet which keeps the safety shutter against a compressed spring; when the shutter is in the open position, that is to say it does not prevent the gas from flowing through the supply circuit. The safety device is in the set position, ready to perform its function. Thus, in the event of failure, for example if the gas is no longer being burnt in the burner, and therefore near the thermocouple, the potential difference disappears, the electromagnet is no longer activated and the safety shutter is free to move under the impulse of the spring, and this drives it into the closed position to shut off the gas supply. The same thing happens when the gas flow-regulating control valve is closed, that is to say that it prevents gas from being supplied to the burner, because then no flame can heat up the thermocouple.

The simple manipulating of the valve by an operator, that is to say the opening of the supply-regulating control valve to a greater or lesser extent, therefore has no influence on the supply to the burner as long as the device is not set, that is to say as long as the safety shutter is in the closed position. There are therefore mechanical setting devices that allow the shutter to be kept open, by deliberate action on the part of the operator, at least until the burner has been lit and enough of a potential difference has been created to activate the electromagnet.

A rotary knob is generally situated above a casing of the hob. Through it being turned in a horizontal plane, it allows the extent to which the valve is opened to be adjusted, that is to say it allows the desired gas flow rate to be set. This knob also, through a vertical upward movement, allows the safety device to be set. It is a vertical control rod, fixed under the knob or operated indirectly by the knob, which transmits the setting instruction, that is to say the upward movement, to the setting device.

Safety and setting devices are generally included in the body of the valve and arranged in the supply circuit, this making it possible to make savings in terms of compactness and to limit the number of gas seals required between excessively numerous components of the supply.

A casing of a built-in hob must be fairly slim, generally thirty millimeters thick, in order to comply with the standards of kitchen furniture manufacturers. Most of the components of the valve are therefore arranged horizontally inside the casing. This is the case of the shutter which moves horizontally under the opposing influences of the setting device and of the spring. The setting device has therefore to allow the vertical control movement of the control rod to be converted into a horizontal movement for opening the shutter.

A first type of safety valve comprises a setting device one part of which transmits the vertical translational movement to a cranked lever, articulated for rotation, which converts the vertical movement into a horizontal movement. Such a device entails arranging several parts and their articulations with precision within the body of the valve. These arranging operations cannot be done by automatic means but must be performed manually. In order to use these parts, the valve body is manufactured in two bits, by casting or forging, one to accommodate the parts and the other to act as a lid for the first. A seal is also arranged between the two bits. A valve such as this is expensive and its setting device is delicate in proportion to its complexity.

A second type of valve comprises a setting device which uses two ramps each mounted for translation, sliding one along the other, and the slopes of which are designed to convert the vertical movement of one ramp into a horizontal movement of the other. Such a device also has disadvantages. The precision of its production and of its mounting has to be very high given the small travel of the ramps. Further, as one ramp does not bear on the other axially, it generates radial forces and wear in bearings for guiding them and the rubbing-together of the ramps causes them both to wear. This wear may cause valve malfunction.

Document GB 2 261 495 describes a safety device of the type mentioned above, in which the setting lever is in the form of a solid and rigid cylindrical bar, of one piece with its two radial arms which are also solid and rigid. Such an arrangement allows no offset between the respective travels of the actuating rod and of the safety valve shutter rod. This demands both high precision in the manufacture of the setting lever and of its arms, which makes it an expensive part, and in the adjustment of the parts during assembly, which increases the cost of manufacture.

A European standard dictates that a safety valve be capable of performing at least 40,000 operations without failing. All the parts have therefore to have good resistance to the friction to which they are subjected. Significant friction leads therefore to high costs of manufacture of these parts.

BRIEF SUMMARY OF THE INVENTION

It is an object of the invention to propose a fuel supply valve comprising a setting device that is simple and reliable to operate, for converting the control movement, for example vertical, of a control rod into a setting movement, for example horizontal, for the safety device.

According to the invention, a safety device as mentioned above is characterized in that the setting lever is elastically deformable in torsion, by virtue of which the driving means can effect an over-travel with respect to the driven means.

If the tabs run in roughly mutually perpendicular respective directions, they allow a control movement to be converted into a perpendicular setting and thrusting movement. The lever axis will advantageously be arranged at right angles to the directions of the control and thrusting movements.

In order to limit the number of seals and special purpose arrangements, the device will be included in a cavity of a fuel supply circuit, preferably one that already exists, in a body of the valve. In order to minimize pressure drops as the fuel flows through the cavity, the setting lever will have a small cross section. It may be made of bent sheet metal. For use in a gas supply, the lever will need to be insensitive to a temperature of 150° C., that it might experience either because of the proximity of the burner or because of the flow of gas, that is to say that its behavior must not be affected by a temperature of 150° C. or lower.

Making the lever from bent sheet metal makes it possible to guarantee a small cross section perpendicular to the direction of gas flow, that is to say transversely with respect to the supply circuit. This cross section and the small pressure drops it creates means that the supply circuit need not be oversized in order to allow the gaseous mixture to flow therein under satisfactory conditions.

It may also be produced by means other than bending a metal sheet and have more or less the same shape, guaranteeing it a cross section, measured at right angles to the gas flow, that is small.

Aside from the small pressure drops created, the reduced cross section makes it possible to give the lever a certain elasticity, particularly in terms of torsion about an axis perpendicular to this section. This elasticity can be put to several uses, particularly for keeping the lever preloaded between the setting command and the shutter, so that the transmission of the command is without play and gives fluidity in the command, and therefore is comfortable for the user. This elasticity can also be used to absorb certain manufacturing tolerances and therefore to reduce the cost of manufacture of the valve while at the same time ensuring that it operates safely.

Bent stainless steel sheet gives, for the desired cross section, both good lever integrity and the desired elasticity. Of course, the lever may also be made from other materials which will give the same elasticity for cross sections compatible with the flow of gases through the supply circuit.

Advantageously, the setting lever will comprise self-positioning means for positioning itself in the cavity and the shape of the cavity will be tailored to accommodate these self-positioning means. The cavity will, for example, comprise a closed end comprising self-centering means for an anterior end of the lever along a theoretical lever axis. An orifice at the opposite end to the closed end along the theoretical axis and opening to the outside of the valve body will serve for introducing the lever into the cavity. The orifice will be closed by a shut-off stopper comprising self-centering means for a posterior end of the lever on the theoretical lever axis and sealing the cavity against the outside.

To guarantee the position of the lever in the cavity when fitting the shut-off stopper, precentering means may be provided on the lever for precentering the lever in the cavity. These precentering means keep the posterior end of the lever in a position close to the theoretical axis, which position allows it to collaborate with the self-centering means of the stopper, when the latter is being fitted, when the lever is no longer accessible from outside the valve body. This arrangement allows the lever to be mounted "blind" in the cavity. As a preference, the self-centering means in the closed end of the cavity and on the stopper will act as bearings for the rotation of the setting lever, this having the purpose of simplifying the design and manufacture of the setting device.

DETAILED DESCRIPTION OF THE INVENTION

Figure 1:
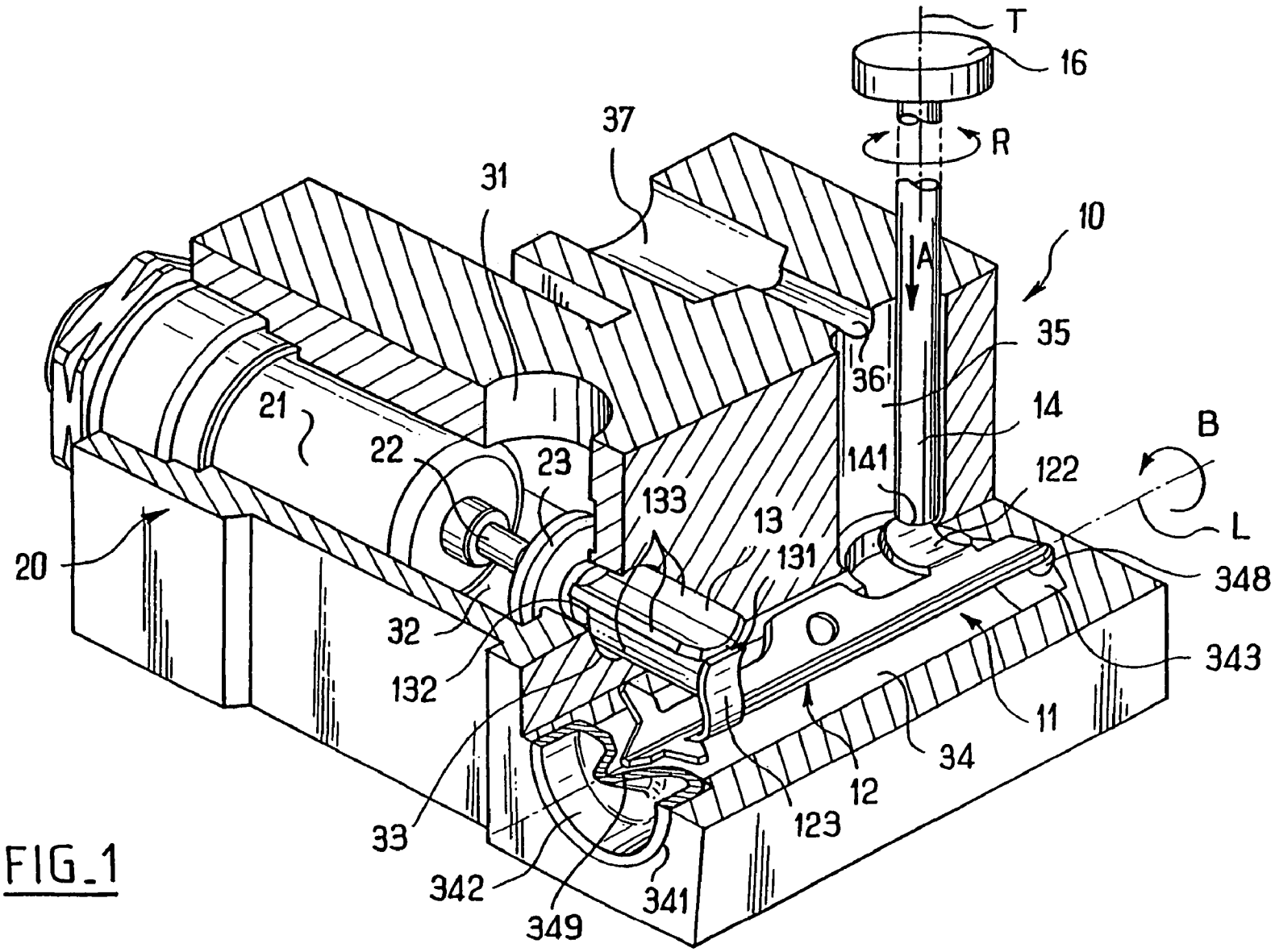
FIG. 1 is a partial depiction, in perspective and in section, of one possible configuration of a valve according to the invention, the safety device of which is in the closed position.
Figure 2:
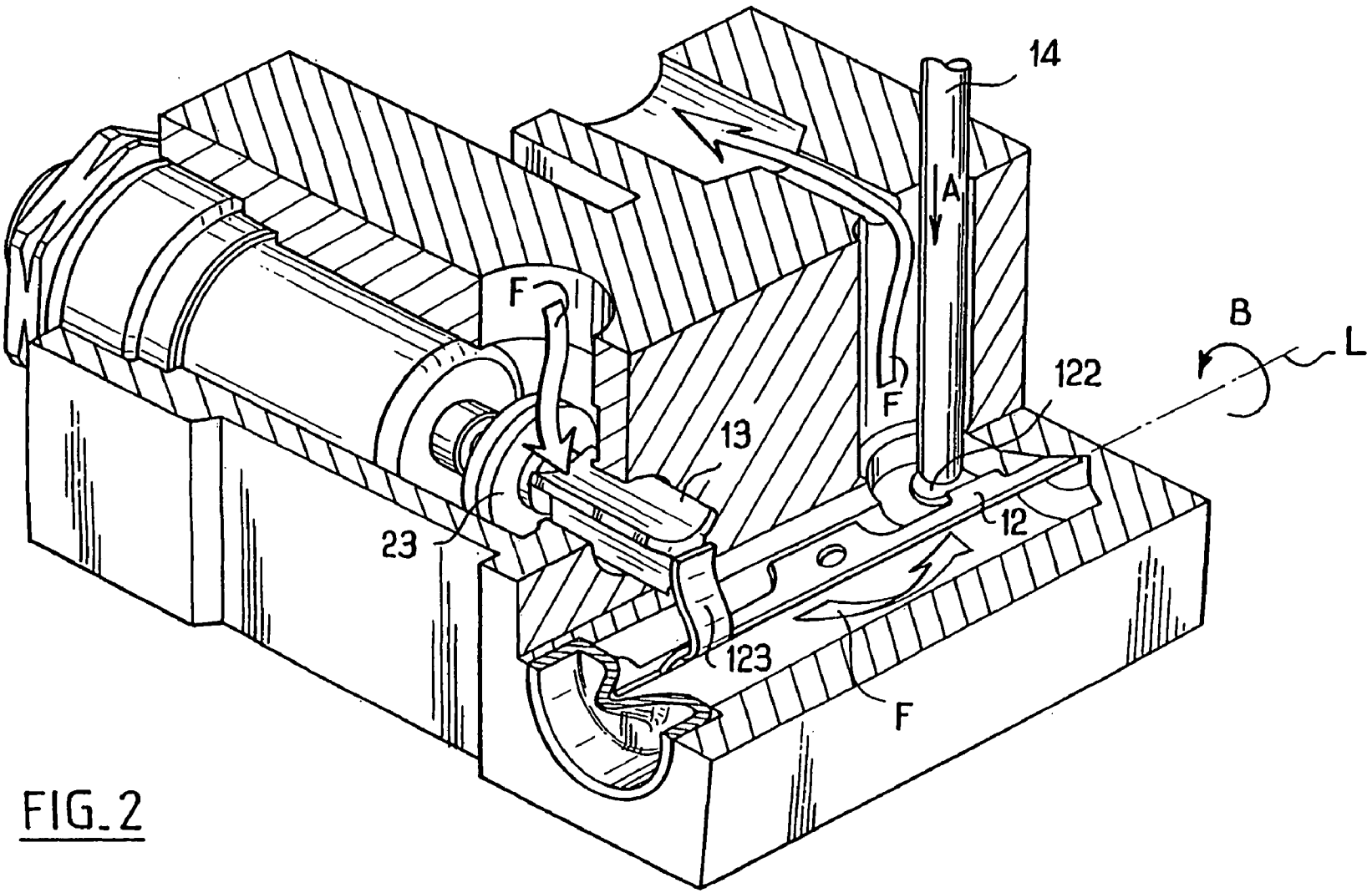
FIG. 2 is a depiction of the valve of FIG. 1, the safety device of which is in the open position.

FIGS. 1 and 2 depict, in section and in perspective, a body 10 of a safety valve according to the invention, designed to be mounted in a hob using gas. The body comprises a safety device 20 mounted in a gas supply circuit. The safety device 20 is depicted in a closed position in FIG. 1, that is to say that it prevents gas from flowing through the supply circuit. The safety device 20 is depicted in an open position in FIG. 2.

The supply circuit comprises, in succession, in the body 10, an inlet pipe 31 letting gas into an inlet chamber 32, a safety orifice 33 at the intersection of the inlet chamber and of an intermediate cavity 34, the intermediate cavity, a regulating chamber 35, a regulating orifice 36 and a gas outlet 37 for the outlet of gas to a burner, not depicted.

The body 10 is output as a section piece the section of which is tailored to the shape of the body, that is to say that the section piece is output transversely in slices the thickness of which is more or less that of the body. The supply circuit is created by making holes in the section piece. The holes are secant to one another in pairs so as to ensure the continuity of the supply circuit. They are more or less cylindrical and are blind, that is to say do not pass through the body. The holes have a starting orifice where the hole has been started on the section piece and a closed end axially opposite the starting orifice, where the hole stops. This closed end consists at least of a wall of a secant hole. The starting orifices may be used as orifices for introducing components of the valve into the supply circuit.

For the clarity of the drawing, the inlet pipe 31 has been depicted as opening vertically into the inlet chamber 32. However, in order to restrict the thickness of the valve body, this pipe is preferably horizontal. It brings the gas from a gas distribution line set for distributing gas to each of the valves of the hob, as far as the inlet chamber.

Apart from a thermocouple positioned in the burner, the safety device 20 is arranged in the inlet chamber. It is therefore upstream in the supply circuit. It is thus able, by cutting off the flow of gas downstream of the safety orifice if necessary, to optimize safety. The safety device consists of a more or less cylindrical housing 21 and of a piston 22 mounted to slide, along an axis of revolution S of the housing 21, through one of the walls of the housing. The housing includes an electromagnet, not depicted, which, when activated by the thermocouple, causes the piston to enter the housing. The housing also contains a spring, not depicted, which tends to extract the piston from the housing.

One end of the piston 22, external to the housing, is equipped with a shutter 23. If the electromagnet is not active, that is to say if the potential difference in the thermocouple is insufficient, the shutter 23 is kept in or brought into a closed position (see FIG. 1) on the safety orifice 33 by the action of the spring. Thus, there is no longer any communication for the gas in the inlet chamber with the supply circuit downstream of the safety orifice 33.

Under normal operating conditions, to activate the electromagnet gas needs to be burnt in order to increase the temperature in the burner and create a potential difference in the thermocouple that powers the electromagnet. However, in order to be able to burn gas in the burner, therefore near the thermocouple, the gas flow-regulating control valve regulating the flow of gas through the safety valve needs to be open and the shutter needs to be in an open position to allow the gas to pass into the supply circuit, downstream of the safety orifice 33, as far as the burner.

It is a mechanical setting device 11 which, when the electromagnet is not active, allows the shutter 23 to be brought into and kept in the open position, that is to say it counters the action of the spring that tends to keep the shutter in the closed position.

When the safety device is set, using the setting device, the shutter is therefore in an open position, which means that the gas in the inlet chamber can pass through the safety orifice 33 into the intermediate cavity 34 and then beyond, if the control valve is open. If the gas is burnt properly in the burner, the potential difference arises in the thermocouple under the action of the increase in temperature. As soon as the potential difference is sufficient, that is to say that the force exerted by the electromagnet on the piston overcomes the force exerted thereon by the spring, the piston is kept retracted into the housing through the action of the electromagnet. The action of the setting device on the shutter becomes superfluous and may be released.

The setting device, the operation of which is described later on, comprises a setting lever 12, a spacer piece 13, and a control rod 14.

The spacer piece 13 is arranged longitudinally through the safety orifice 33. It has a shape tailored for its guidance at the periphery of the safety orifice and so that it can slide therein. It has a cross section that allows gas to flow through the orifice 33, between the inlet chamber 32 and the intermediate cavity 34 when the shutter 23 is in the open position. In the example chosen, the safety orifice is cylindrical and the spacer piece has a cross section in the shape of a three-branch star 133. The branches serve to guide the spacer piece along the interior wall of the safety orifice. The gas can flow longitudinally between the branches of the star. The spacer piece runs longitudinally between two domed ends 131, 132, the first 131 facing toward the intermediate cavity 34 and the second 132 facing toward the inlet chamber 32. In the example described, the spacer piece is made of fiber-reinforced plastic, giving it significant strength for a small cross section at a lower cost than metal. The inlet chamber, the safety orifice and the spacer piece are more or less coaxial with the axis S, depicted in FIGS. 5 and 6, of the housing 21.

The valve serves to regulate the flow of gas through the burner, and therefore to regulate the speed at which the burner heats. A knob 16, for actuating the rod 14, is accessible by an operator to control the valve. The rod, more or less cylindrical of axis T, is arranged vertically. A control valve, not depicted, makes it possible, by closing off the regulating orifice 36 to a greater or lesser extent, to alter the flow of gas in the burner. The operator can regulate the flow rate by turning R the knob 16 about a vertical axis, and this has the effect of moving the regulating control valve past the regulating orifice 36, and therefore of closing it off to a greater or lesser extent. The regulating chamber comprises sealing means, beyond the control valve and before the control knob 16, that is to say near the starting orifice for the regulating chamber, around the rod 14. Thus, if the valve is open, the gas can flow into the regulating chamber only from the intermediate cavity to the outlet 37 through the regulating orifice 36, without being able to escape out of the supply circuit.

In FIG. 1, the axis of rotation R of the knob 16 is depicted as coinciding with the axis T of the rod 14. However, the knob is not generally fixed to the rod 14 that it controls then only indirectly, and the rod 14 may be arranged to have just a translational movement along the axis T. The axis of rotation of the knob 16 may therefore differ from the axis T.

Figure 3:
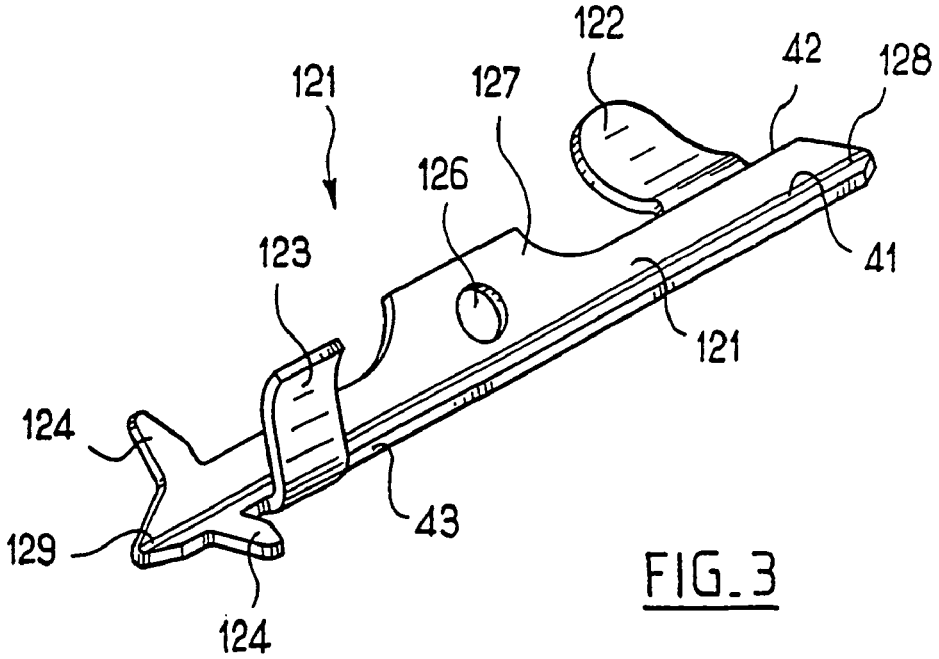
FIG. 3 is a perspective view, on a larger scale, of a setting lever as used in the valve of FIGS. 1 and 2.

The control lever 12 is made of thin stainless steel sheet. This sheet has been cut, bent and shaped to give it the shape more specially depicted in FIG. 3. The lever is of fairly elongate shape; it comprises a beam 121 running longitudinally between an anterior end 128 and a posterior end 129. The beam 121 has a V-shaped cross section about a longitudinal fold 41 which gives the beam certain rigidity in terms of longitudinal bending. The ends 128, 129 of the beam 121 are cut to the shape of points, and between each of the points define an axis L for the lever. The lever axis L is more or less coincident with the longitudinal fold 41 of the beam 121.

The setting lever 12 also comprises a driving tab 122 and a driven tab 123. The driven tab runs transversely from a longitudinal edge 42 of the beam, near the anterior end 128. The driven tab 123 runs transversely from a longitudinal edge 43 of the beam, the opposite edge to the edge 42, near the posterior end 129.

Two fins 124 run transversely, one from the edge 42 and the other from the edge 43, more or less in the continuation of the V formed by the beam, one facing the other, in close proximity to the posterior end 129. The fins are precentering means for the posterior end when the lever is being mounted in the intermediate cavity.

In the example described, the lever is mass-produced from a sheet metal strip. For that, it comprises an indexing hole 126 and an appendage 127. The hole 126 serves to index the sheet in the machines for manufacturing the lever. The appendage 127 is a vestige of the portion of sheet metal connecting the future lever, while it is being manufactured, to another future lever next to it in the sheet.

The intermediate cavity 34 (see FIG. 1) comprises a starting orifice which serves as an orifice 341 for introducing the lever 12 into the intermediate cavity, and a closed end 343. The closed end comprises a coaxial cone 348 coaxial with the intermediate cavity. Once the lever has been introduced into the intermediate cavity 34, this cavity is plugged by a stopper 342 forcibly fitted into the starting orifice 341 to seal against gas between the inside and the outside of the supply circuit. The stopper 342 comprises a cone 349 roughly coaxial with the cavity 34, once the stopper has been fitted into the starting orifice 341. The cone 348 of the closed end and the 349 of the stopper respectively complement the anterior 128 and posterior 129 ends of the beam 121. They respectively define, for each of the ends, an anterior bearing 348 and a posterior bearing 349. The bearings define a theoretical axis of rotation for the lever 12 in the cavity 34 and act as stops for the longitudinal positioning of the lever in the cavity 34. When the lever 12 is in place in the cavity 34, between the bearings 348, 349, the theoretical axis is more or less coincident with the lever axis L.

The tabs 122, 123 are arranged on the lever 12 so that, in a position in which the lever is in place in the cavity 34, the driving tab 122 runs roughly diametrically to the regulating chamber 35 and in alignment with the regulating chamber, and so that the driven tab 123 runs more or less diametrically to the safety orifice 33 and in alignment with said orifice and with the inlet chamber 32.

We shall now describe the operation of the setting device with reference to FIGS. 1 and 2. According to a widespread principle of operation of a safety valve suited to a gas hob, pressure by the operator on the knob 16 makes it possible, by moving the knob 16 and the rod 14 whose translation it drives vertically downward in the direction A parallel to the axis T, to set the safety device 20. Return means, for example a compression spring, allow the rod 14 and the knob 16 to be returned, in the opposite direction to A, to a position of rest.

In FIG. 1, the control rod 14 is in its rest position, that is to say it exerts no action on the setting device 11. The shutter 23 is in a closed position and no gas flows through the supply circuit between the inlet pipe 31 and the outlet 37, independently of the closing-off of the regulating orifice 36. To light the burner downstream of the valve 1, the operator opens the valve, that is to say the control valve closing off the regulating orifice 36, via an appropriate turning R of the knob 16 and pushes down on this knob to move the control rod translationally downward, vertically, along A. During this translational movement, a lower end 141 of the rod 14 comes into contact with the driving tab 122. A domed lower end will advantageously be anticipated.

The axis T of the rod 14 is more or less perpendicular to the lever axis L, and the two axes are not secant. Thus, while the translational movement A continues, the driving tab 122 is at the same time driven downward and the setting lever 12, to which the driving tab is connected in terms of movement, begins a swinging movement on B about the lever axis L. The driven tab 123, it too connected in terms of movement to the lever 12, is driven in the movement of the lever, toward the safety orifice. During this swinging movement, the driven tab is pressed against the first domed end 131 of the spacer piece 13.

The lever axis L and the axis S of the safety device are not secant and are more or less perpendicular. Thus, while the swinging movement B continues, the spacer piece begins a horizontal translational movement which will press its second domed end against the shutter 23. As its travel continues, under the impulse of the rod 14 relayed by the setting lever 12, the spacer piece 13 pushes the shutter 23 back into an open position.

The movements described are halted when the stopper 23 or the piston bearing the shutter encounters a first stop provided for that purpose. It is preferable to provide a second stop to limit the travel of the rod. A setting lever as set out in the example has a certain torsional elasticity about the lever axis L. This elasticity makes it possible to absorb an over-travel of the rod 14 along A, therefore an over-travel of the driving tab along B, although the safety device is already in abutment against the first stop and the rod has not reached the second stop. Thus, the driving tab 122 continues its travel along B, about the lever axis L, while the driven tab 123 is more or less immobile. The over-travel thus absorbed makes it possible to conceal dimensional discrepancies and/or play resulting either from the methods and tolerances with which the valve was manufactured, or from valve wear. The over-travel is therefore desirable and can be defined constructively. As a preference, the elasticity of the lever will be designed to be compatible with this over-travel, that is to say to make it possible to absorb it entirely. The setting lever also, by virtue of this over-travel, acts as a damper for the setting device, and this gives the valve a longer life and is more comfortable for the user. In the example described, the elasticity of the lever about the lever axis L increases with the elongation of the beam 121.

When the shutter is in the open position, the safety device is in the set position, that is to say that if gas flows in the direction of the arrows F as illustrated in FIG. 2, in the supply pipe as far as the burner, all that is required is for the gas to be lit, automatically or manually, so that it can be burnt and a potential difference can be created in the thermocouple that is sufficient for the device to become set.

Once the safety device is set, the operator can release his pressure on the control knob 16. The rod then reverts to its rest position for which the setting device does not force the shutter to remain in the open position, that is to say that the setting device allows the shutter to move freely between its open and closed position. Thus, the device remains set until it is made to close, for example if the gas supply to the burner is cut off.

To limit the lateral loads in the translating parts of the setting device, that is to say the rod 14 and the spacer piece 13, the tabs are given a shape such that a force that one of them transmits to one of the translating parts is applied more or less along the axis of this part, for example to a vertex of a domed end of the part. In particular, the shape of the tab is such that, at a point of contact of the vertex with a contact surface of this tab, the contact surface is always tangential to the domed end and perpendicular at this point to the axis of the translating part.

The swinging of the lever as described generates little friction and does not appreciably alter the pressing force needed to operate the control knob 16.

Figure 4:
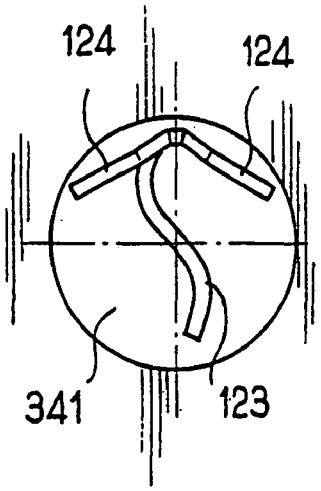
FIGS. 4 to 6 illustrate a method for mounting the lever of FIG. 3 in a valve body according to the invention.
Figure 5:
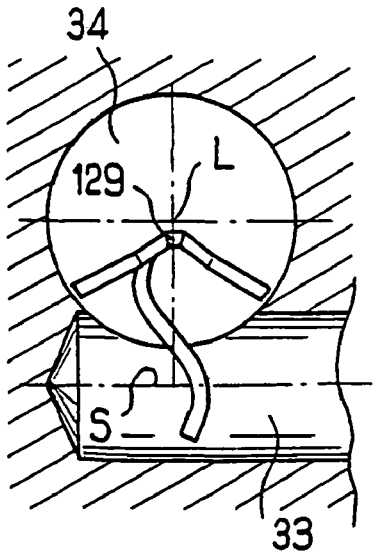
Figure 6:
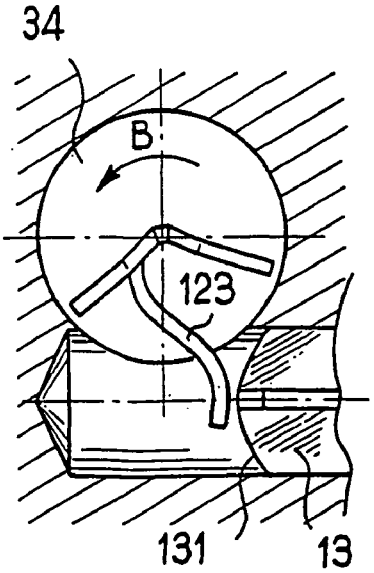

We shall now describe a method for mounting the setting lever 12 in the intermediate cavity 34, particularly with reference to FIGS. 4 to 6, drawn in planes perpendicular to the theoretical axis defined by the cavity 34. FIGS. 4 to 6 illustrate two steps in the mounting of the lever. FIG. 6 illustrates the mounted lever, once the stopper 342 has been fitted. During the fitting of the stopper 342 in the starting orifice 341, it is not possible using mechanical or manual means to make sure that the lever 12 is correctly positioned in the cavity 34. The lever and the method are therefore designed to guarantee perfect self-positioning of the lever in the cavity.

It can be seen, as illustrated particularly in FIG. 6, that in order to come into contact with the first domed end 131 of the spacer piece 13 at the axis S, the driven tab extends beyond the lever axis L over a distance greater than a radius of the intermediate cavity. Thus, the posterior end of the lever needs to be offset when the driven tab is passed through the introduction orifice 341, as illustrated in FIG. 4.

In opposition to this, the anterior end 128 of the lever 12 is positioned exactly in its bearing 348. For that, the body 10 is kept in a mounting position, inclined enough for the vertex of the cone that acts as an anterior bearing 348 to be a low point for the cone. Thus, as the lever is introduced into the cavity, when the anterior end of the lever is placed in the anterior bearing, there is no risk of said end coming out of the bearing, or of it doing so during the subsequent mounting operations.

In the mounted position, care is taken to ensure that the relative positions of the lever axis L and the axis of the safety system S are such that, once the anterior end has been positioned in the anterior bearing, all that is required is for the posterior end of the lever to be released for the driven tab to position itself facing the safety orifice 33 simply under the action of gravity, as illustrated in FIG. 5. As the stopper 342 is fitted, the holding of the posterior end 129 can no longer be ensured by external means. To make sure that the posterior end will position itself correctly in the posterior bearing. 349, the lever is held in a precentered position, resting on the fins 124 under the action of its self weight alone. These fins are designed so that, in the precentered position, the posterior end is close enough to the lever axis L enters the posterior bearing 349 as the stopper 342 is fitted into the introduction orifice 341.

The fins are short enough that they do not rub against the walls of the intermediate cavity 34 when the setting lever 12 swings about B (see FIG. 6). Thus, they do not center the lever perfectly but simply precenter it (see FIG. 5). Furthermore, the fins 124 have not to impede the offsetting of the posterior end when passing through the introduction orifice. For this, as illustrated in FIG. 4, the fins form a dihedral the vertex of which is opposed to the direction of extension of the driven tab 123, that is to say that the driven tab sits inside the dihedral angle.

Of course, the invention is not restricted to the example which has just been described and many variations can be made to this example without departing from the scope of the invention.

The body of a valve according to the invention is not necessarily output as a section piece. For more complicated shapes, for example for a valve comprising several outlets each supplying one ring of a multi-ring burner, it may be produced by casting.

This valve may be used on the front face of an oven. In this case, the control direction is more or less horizontal and the pushing direction may be at right angles but does not have to be vertical.

This type of valve can also be adapted to fuels other than domestic gas, for example fuel oil.

The lever may also have a different shape, for example the driving and/or driven tabs may be replaced by, or included in, other respective driving and/or driven means. For example, driving means may be a cylinder rather than a tab.

The lever can also be manufactured using other techniques, for example casting or assembling. It may be made of plastic.

What is claimed is:

1. A safety device for a gas burner, particularly in a cooking appliance, comprising a safety valve provided with a safety shutter included in a circuit for supplying said burner with gas, and with a device for mechanically setting said shutter, comprising:

a setting lever mounted so that it can move in rotation about a lever axis, driving means, secured to the lever and extending substantially transversely to the lever axis, able to drive said lever in rotation in response to a setting command, and driven means, secured to the lever and extending substantially transversely to the lever axis, able to push said shutter into a setting position that allows gas to flow through said burner supply circuit, wherein the setting lever is elastically deformable in torsion, whereby the driving means can effect an over-travel with respect to the driven means.

2. The safety device as claimed in claim 1, wherein said setting lever is mounted in a cavity of the gas supply circuit.

3. The safety device as claimed in claim 1, wherein said setting lever comprises a beam wherein said driving means extend from said beam near a first end of the beam, wherein said driven means extend from said beam near a second end of said beam.

4. The safety device as claimed in claim 3, wherein said lever axis is defined by the first and second ends of the beam.

5. The safety device as claimed in claim 2, wherein said lever comprises self-positioning means for positioning itself in the cavity.

6. The safety device as claimed in claim 2, wherein said cavity has a closed end and an orifice plugged by a stopper and wherein said lever is mounted to rotate between a first bearing in the closed end and a second bearing in the stopper.

7. The safety device as claimed in claim 3, wherein said setting lever is mounted in a cavity of the gas supply circuit, said lever comprises self-positioning means for positioning itself inside the cavity, wherein said cavity has a closed end and an orifice plugged by a stopper, wherein said lever is mounted to rotate between a first bearing in the closed end and a second bearing in the stopper, and wherein said self-positioning means comprise means for precentering one end of the beam near the orifice.

8. The safety device as claimed in claim 7, wherein said precentering means are fins running transversely to the lever axis near the end that is to be precentered.

9. The safety device as claimed in claim 7, wherein at least one of said first and second bearings is designed to collaborate with some of the self-positioning means.

10. The safety device as claimed in claim 9, wherein at least one end of said beam is in the shape of a point to cooperate with a cone-shaped bearing, particularly so as to self-position said end in said bearing.

11. The safety device as claimed in claim 1, comprising a control rod mounted in translation to transmit the setting command, wherein said driving means and said rod are designed so that a contact force of the driving means on the rod is transmitted more or less along the axis of said rod.

12. The safety device as claimed in claim 1, comprising a spacer piece operationally associated with the safety shutter and mounted in translation to receive the setting command, wherein said driven means and said spacer piece are designed so that a contact force of the driven means on the spacer piece is transmitted more or less along the axis of said spacer piece.

13. The safety device as claimed in claim 1, wherein said lever is made of cut and bent sheet metal.

14. The safety device as claimed in claim 1, wherein said driving means and/or said driven means comprise a tab secured to the lever.

* * * * *